US005309211A

United States Patent [19]

Yoshioka

[11] Patent Number: 5,309,211

[45] Date of Patent: May 3, 1994

[54] PROCESS UNIT HAVING TWO CHAMBERS FOR STORING WASTE DEVELOPER

[75] Inventor: Satoru Yoshioka, Yokohama, Japan

[73] Assignee: Ricoh Company, Ltd., Tokyo, Japan

[21] Appl. No.: 966,588

[22] Filed: Oct. 26, 1992

Related U.S. Application Data

[63] Continuation of Ser. No. 755,830, Sep. 6, 1991, abandoned.

[30] Foreign Application Priority Data

Sep. 12, 1990 [JP] Japan ..... 2-241511

[51] Int. Cl.[5] ..... G03G 21/00

[52] U.S. Cl. ..... 355/298; 355/200; 355/210; 355/260

[58] Field of Search ..... 355/298, 296, 200, 210, 355/245, 260

[56] References Cited

U.S. PATENT DOCUMENTS

| | | | |
|---|---|---|---|
| Re. 33,484 | 12/1990 | Imanaka | 355/298 |
| 4,627,716 | 12/1986 | Oka | 355/298 |
| 4,659,212 | 4/1987 | Ichihara et al. | 355/298 |
| 4,664,505 | 5/1987 | Itaya et al. | 355/298 |
| 4,894,688 | 1/1990 | Taniguchi et al. | 355/298 |
| 5,036,369 | 7/1991 | Toda et al. | 355/298 |
| 5,047,801 | 9/1991 | Haneda et al. | 355/200 |
| 5,113,227 | 5/1992 | Miyasaka | 355/298 |

FOREIGN PATENT DOCUMENTS 230178 11/1985 Japan ..... G03G 21/00

*Primary Examiner*—A. T. Grimley
*Assistant Examiner*—Sandra L. Brasé
*Attorney, Agent, or Firm*—Cooper & Dunham

[57] ABSTRACT

A process unit mounted in a housing of a laser printer includes a developing device for supplying toner to a latent image formed on a photosensitive member so that a visible toner image corresponding to the latent image is formed on the photosensitive member, a first chamber provided adjacent to the developing device, a second chamber connected via an opening to the first chamber, and a feeding mechanism for feeding waste toner to the first chamber, the waste developer being removed from the photosensitive member by a cleaning device after the visible toner image is transferred to a recording sheet. Thereby, the waste developer fed to the first chamber is further fed via the opening to the second chamber so that the waste developer is stored in the first and second chambers.

18 Claims, 6 Drawing Sheets

PROCESS UNIT HAVING TWO CHAMBERS FOR STORING WASTE DEVELOPER

This is a continuation of application Ser. No. 07/755,830, filed Sep. 6, 1991, now abandoned.

BACKGROUND OF THE INVENTION

The present invention generally relates to a process unit used in an electrophotography imaging apparatus such as a laser beam printer, a copy machine, or a facsimile set, and more particularly to a process unit having a developing device and a storage box which stores waste developer fed from a cleaning device.

In a general electrophotography imaging apparatus such as a laser printer, a developing device develops a latent image which is optically formed on a image retaining member (e.g. a photosensitive drum) That is, toner (developer) is adhered to the latent image formed on the image retaining member. Then this toner image is transferred from the image retaining member to a recording sheet and fixed thereon by a fusing unit. Most of the toner forming the image can be transferred to the recording sheet, but a small amount of the toner remains on the surface of the image retaining member. A cleaning unit cleans the residual toner from the image retaining member so that a new latent image can be formed on the image retaining member. The residual toner removed from the surface of the image retaining member is, as waste toner, stored in a storage box. Conventionally, the storage box is placed adjacent to the cleaning unit, and the residual toner is fed from the cleaning unit to the storage box, for example, as disclosed in Japanese Laid Open Patent No. 60-230178.

On the other hand, a process unit including the developing device which is detachably mounted in a main assembly of the electrophotography imaging apparatus has been proposed. In this electrophotography imaging apparatus, if the storage box in which the waste toner is stored is mounted in the process unit, the waste toner can be removed from the electrophotography imaging apparatus when the process unit is exchanged for a new one.

In a case where the storage box in which the waste toner is stored is mounted in the process unit, there is a disadvantage in that the process unit becomes large.

SUMMARY OF THE INVENTION

Accordingly, a general object of the present invention is to provide a novel and useful process unit for use in an electrophotography imaging apparatus in which the disadvantage of the aforementioned prior art is eliminated.

A more specific object of the present invention is to provide a process unit for use in an electrophotography imaging apparatus in which a large amount of waste developer can be stored and the size thereof can be made as small as possible.

The above objects of the present invention are achieved by a process unit mounted in a housing of an electrophotography imaging apparatus in which an image is formed in accordance with an electrophotography process carried out on an image retaining member, the process unit comprising: a developing device for supplying developer to a latent image formed on the image retaining member so that a visible image corresponding to the latent image is formed on the image retaining member; a first chamber provided adjacent to the developing device; a second chamber connected via an opening to the first chamber; and a feeding mechanism for feeding waste developer to said chamber, the waste developer being removed from the image retaining member by a cleaning device in the electrophotography imaging machine after the visible image is transferred from the image retaining member to a recording sheet, whereby the waste developer fed to the first chamber is further fed via the opening to the second chamber so that the waste developer is stored in the first and second chambers.

According to the present invention, as means for storing the waste developer such as waste toner is divided into the first chamber and second chamber, the degree of freedom with which the means for storing waste developer in the process unit can be arranged increases. Thus, the process unit can be made as small as possible.

Additional objects, features and advantages of the present invention will become apparent from the following detailed description when read in conjunction with the accompanying drawings.

DESCRIPTION OF THE PREFERRED EMBODIMENTS

A description will now be given of a process unit according to an embodiment of the present invention with reference to FIGS. 1 through 7.

Figure 1:
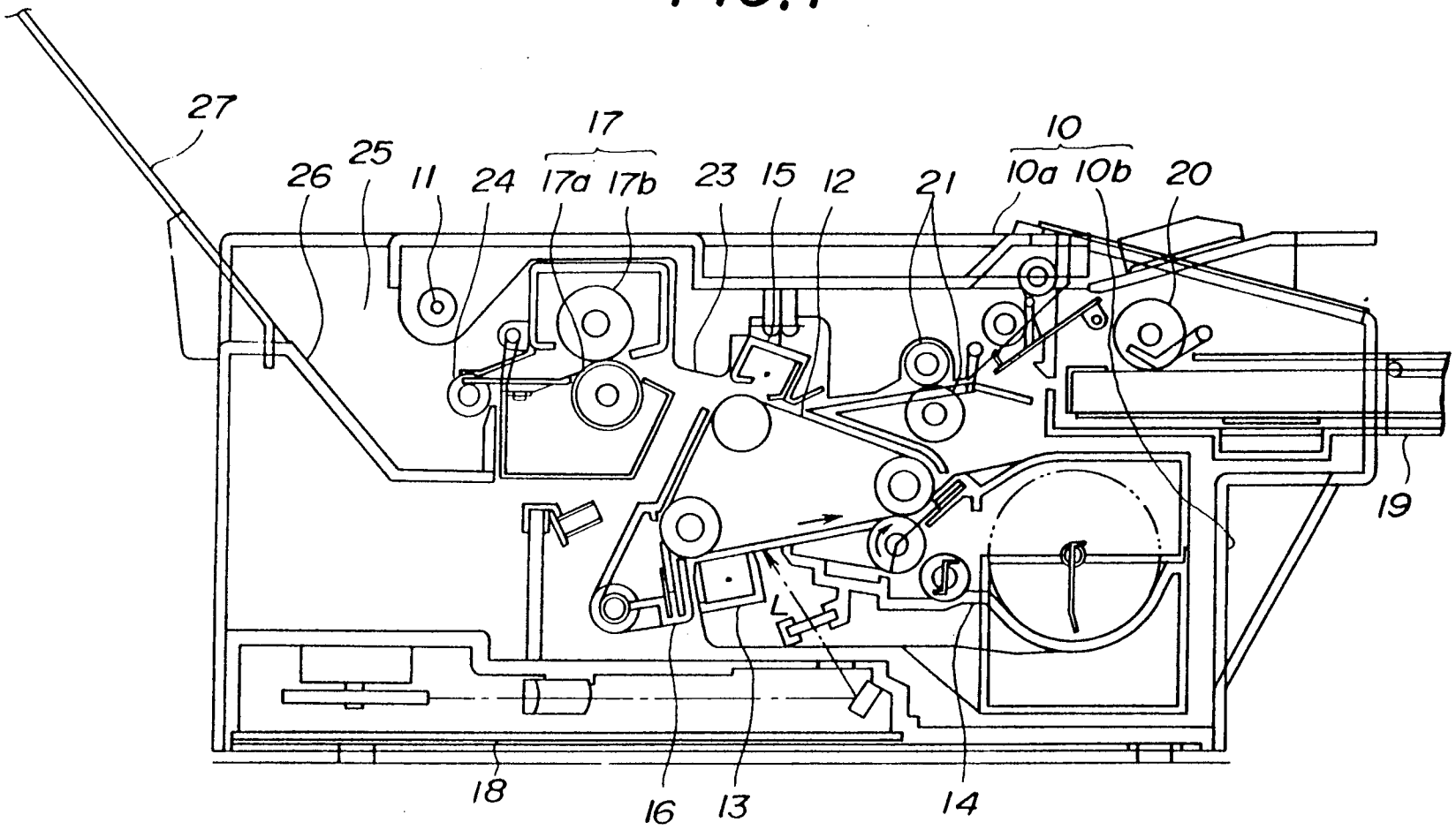
FIG. 1 is a sectional view showing a laser printer in which a process unit according to an embodiment of the present invention is mounted.

Referring to FIG. 1, which shows a laser beam printer in which a process unit is mounted, a laser beam printer has a housing 10. The housing 10 is formed of an upper housing 10*a* and lower housing 10*b*. The upper housing 10*a* and the lower housing 10*b* are connected by a shaft 11 to each other. The upper housing 10*a* is pivoted on the shaft 11 so as to open and close the housing 10. A photosensitive belt 12 (an image retaining member) is mounted in the housing 6 so as to be positioned approximately at a central part of the housing 10. The photosensitive belt 12 is subjected to a drive mechanism including a plurality of rollers so that it is moved in a counterclockwise direction shown by an arrow in FIG. 1 at a constant speed.

A charge corotron device 13, a developing device 14, a transfer corotron device 15, and a cleaning device 16 are arranged in this order around the photosensitive belt 12 in a counterclockwise direction. A optical writing unit 18 is arranged under the charge corotron device 13, the cleaning device 16 and the developing device 14 so that a laser beam L emitted from the optical writing unit 18 passes between the charge corotron device 13 and the developing device 14 and is projected onto the surface of the photosensitive belt 12. A paper supply cassette 19 is detachably set in the housing 10 at the upper right portion of the developing device 14. The paper supply cassette 19 holds recording papers. A recording paper is fed from the paper supply cassette 19 to a pair of registration rollers 21 by a suppling roller 20, and then the recording paper is further fed to the surface of the photosensitive belt 12 by the registration rollers 21 at a predetermined timing.

An electrophotography process (a xerography process) is carried out on the surface of the photosensitive belt 12 which is moved in the counterclockwise direction at a constant speed. That is, a charging step, an exposure step, a developing step, and a transfer step are carried out on the surface of the photosensitive belt 12. In the charging step, the surface of the photosensitive belt 12 is uniformly charged by the charge corotron device 13. In the exposure step, the laser beam L which is modulated in accordance with image data by the optical writing unit 18 is projected onto the surface of the photosensitive belt 12 which has been uniformly charged in the charging step, so that a latent image corresponding to the image data is formed on the surface of the photosensitive belt 12. In the developing step, toner is supplied from the developing device 14 to the surface of the photosensitive belt 12. The toner is adhered to the latent image, so that the latent image on the surface of the photosensitive belt 12 is changed to a visible toner image. In the transfer step, the toner image is transferred from the photosensitive belt 12 to the recording paper fed by the registration rollers 21 by the transfer corotron device 15. The recording paper to which the toner image is transferred is guided by a guide 23 to be fed to a fuser unit 17. In the fuser unit 17, the recording paper moves between a fusing roller 17*a* which is heated by a heater and a pressure roller 17*b*, so that the toner image formed on the recording sheet is fused and fixed thereon. After the recording paper passes through the fuser unit 17, it is fed to an ejection space 25 and then guided to an ejecting tray 27 by a guide plate 26, so that the recording sheet having a toner image formed thereon is stacked on the ejecting tray 27.

After the toner image is transferred to the recording sheet, residual toner remains on the surface of the photosensitive belt 12. The cleaning device 16 removes the residual toner from the surface of the photosensitive belt 12.

Figure 2:
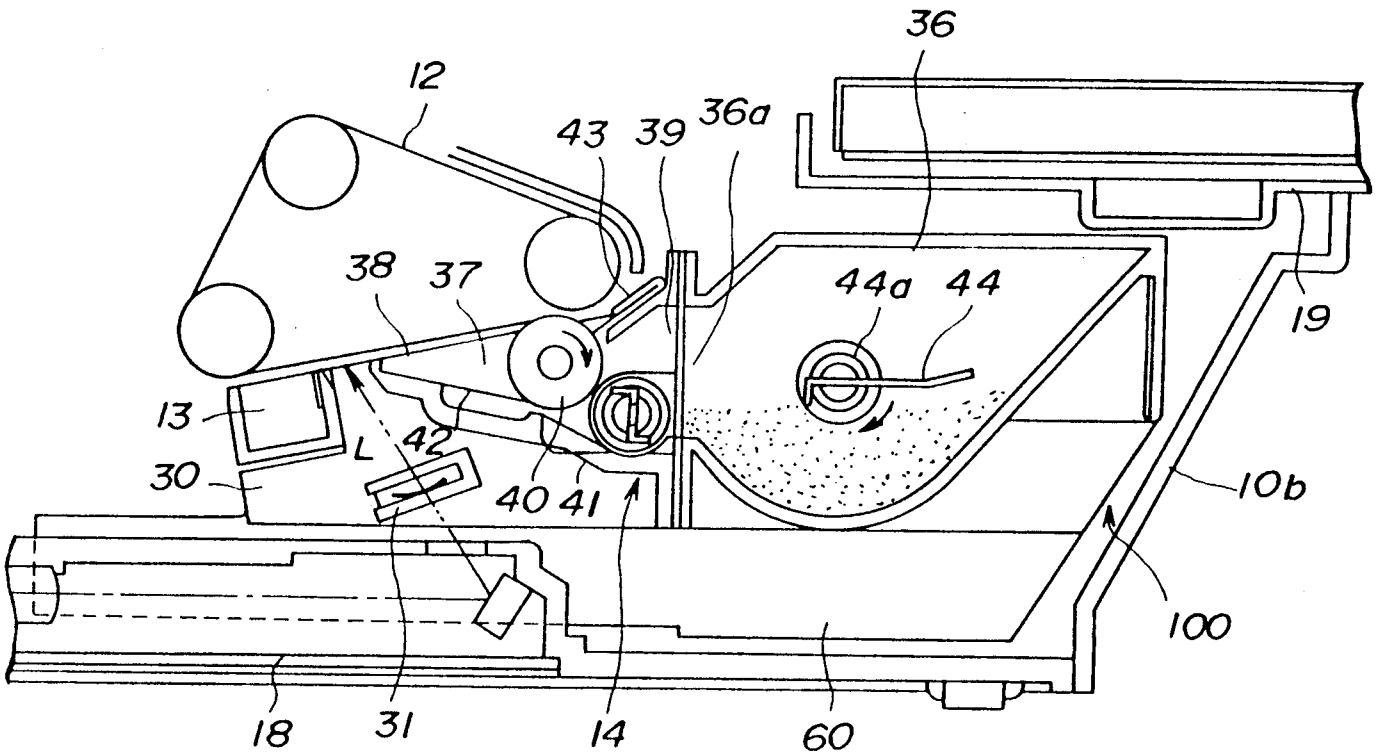
FIG. 2 is a sectional view showing the process unit according to the embodiment of the present invention.

The charge corotron device 13, the developing device 14, an optical block 31 through which the laser beam L from the optical writing unit 18 passes, and a waste toner storage unit 60 are integrated with each other by a frame 30, as shown in FIG. 2. Thereby, a process unit 100 including the charging corotron device 13, the developing device 14, the optical block 31 and the waste toner storage unit 60 is formed. The process unit 100 is detachably mounted in the housing 10 of the laser printer.

The developing device 14 has a toner chamber 36 and a developing chamber 37. An opening 36*a* of the toner chamber 36 and an opening 39 of the developing chamber 37 are connected to each other, so that the toner chamber 36 and the developing chamber 37 are integrated with each other. An agitator 44 which is rotated around a shaft 44*a* is mounted in the toner chamber 36 in which toner T is stored. When the agitator 44 is rotated around the shaft 44*a*, the toner T is agitated in the toner chamber 36 and fed via the openings 36*a* and 39 to the developing chamber 37. The developing chamber 37 has a roller window 38 facing the photosensitive belt 12. A developing roller 40 is mounted in the developing chamber 37 so that a part of the developing roller 40 is exposed from the roller window 38. The toner fed via the openings 36*a* and 39 from the toner chamber 36 is supplied to the developing roller 40 by a toner supplier 41. An edge of a thin blade 42 and an edge of a discharging brush 43 are respectively in contact with the surface of the developing roller 40. When the developing roller 40 is rotated, the toner adhered to the surface of the developing roller 40 is transferred to the latent image formed on the surface of the photosensitive belt 12.

Figure 3:
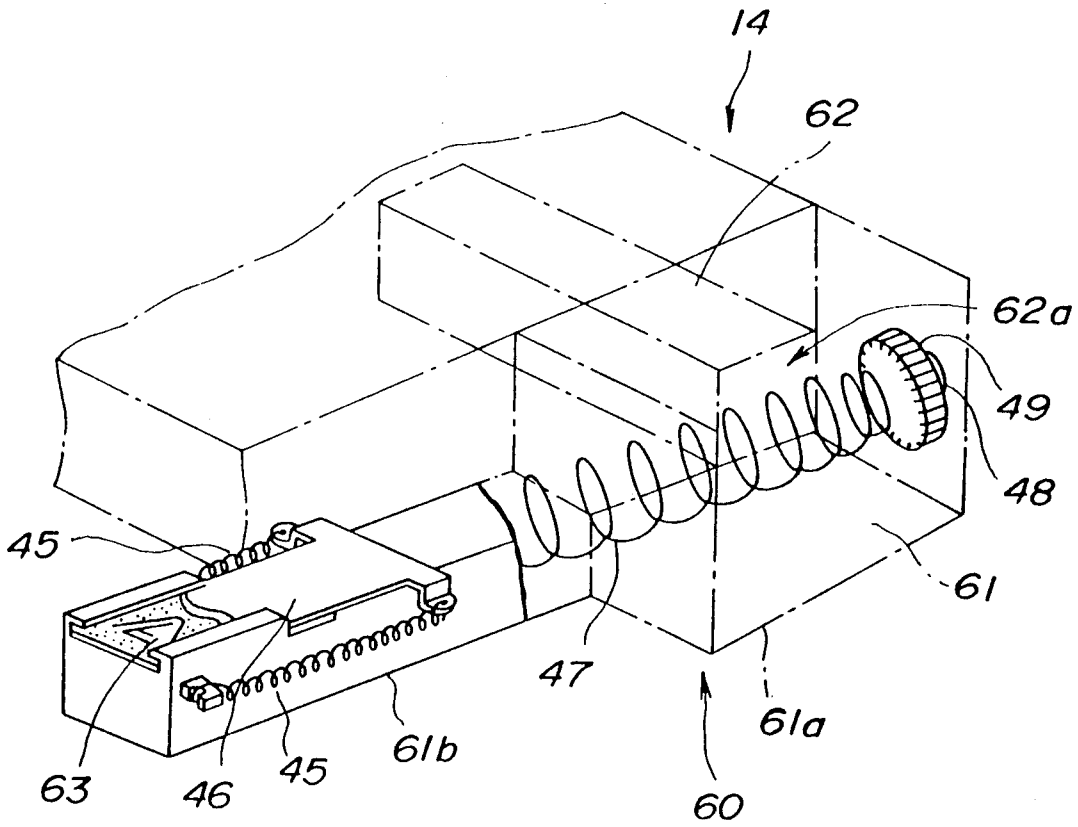
FIG. 3 is a perspective view showing a storage box mounted in the process unit shown in FIG. 2.
Figure 4:
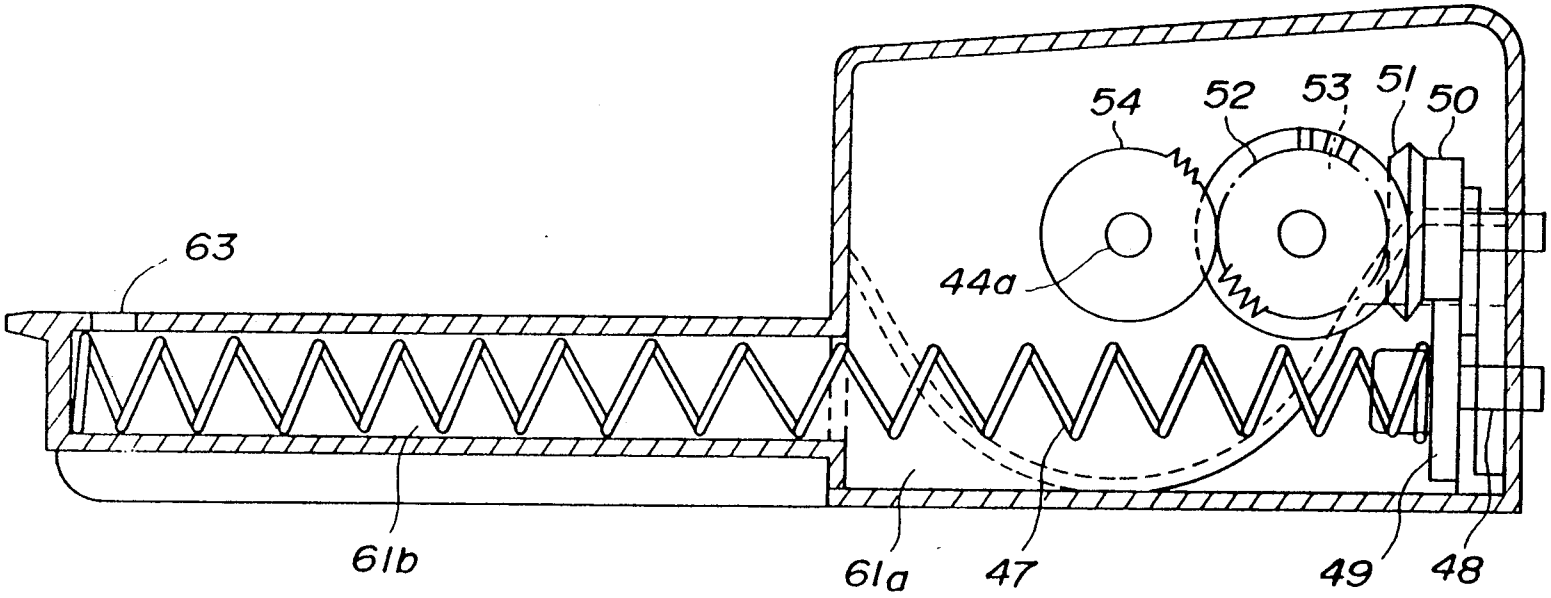
FIGS. 4 and 5 are sectional views showing a mechanism for conveying waste toner to the storage box shown in FIG. 3.
Figure 6:
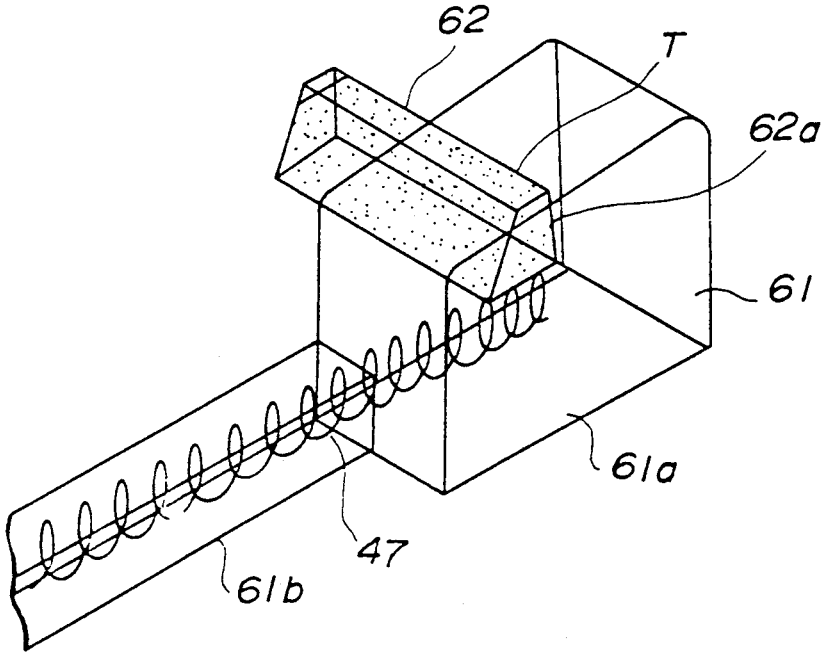
FIG. 6 is a view showing a fundamental structure of the storage box.

The waste toner storage unit 60 is constituted by a storage box 61, in which a first chamber 61*a* is formed, and a second chamber 62, as shown in FIG. 3. The storage box 61 is provided on a side wall of the developing device 14 so that the first chamber 61*a* is positioned at a side of the toner chamber 36 of the developing device 14. The second chamber 62 is positioned below the toner chamber 36 and extends in a direction approximately parallel to the developing roller 40 of the developing device 14. The first chamber 61*a* and the second chamber 62 are joined via an opening 62*a* to each other. A feeding pipe 61*b* is connected to the first chamber 61*a*. The feeding pipe 61*b* extends towards the cleaning device 16 in a state where the process unit 100 is mounted in the housing 10 of the laser beam printer. An opening 63 is formed on an upper surface of the feeding pipe 61*b* at an end part thereof. A lid 46 is slidably provided on the upper surface of the feeding pipe 61*b*. Springs 45 are provided between engage portions formed on the lid 46 and other engage portions formed on the end part of the feeding pipe 61*b*. Thereby, the lid 46 is maintained by the springs 45 at a closed position at which the lid 46 covers the opening 63 when the process unit 100 is detached from the housing 10 of the laser beam printer, and the lid 46 is maintained at an opened position at which the opening 63 is exposed when the process unit 100 is mounted in the housing 10. In a state where the process unit 100 is mounted in the housing 10, the residual toner which is removed from the photosensitive belt 12 by the cleaning device 16 is, as the waste toner, guided to the opening 63 of the feeding pipe 61*b* by a guide member (not shown). A screw 47 is provided so as to extend in the feeding pipe 61*b* and the first chamber 61*a* as shown in FIGS. 4 and 6. A first end of the screw 47 is rotatably supported on an end of the feeding pipe 61*b*, and a second end of the screw 47 is fixed on a gear 49, as shown in FIGS. 4. Thereby, the second end of the screw 47 is extended to a position adjacent to the opening 62*a* of the second chamber 62.

Figure 5:
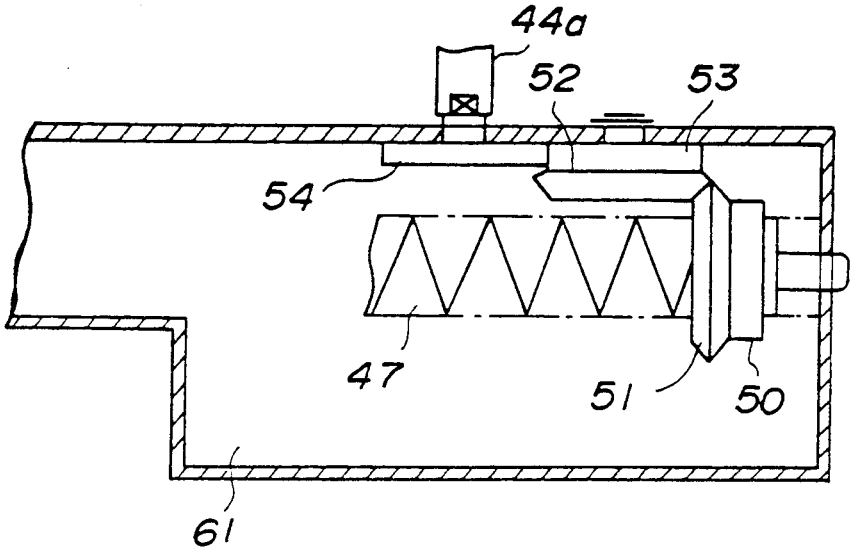

A driving mechanism for rotating the screw 47 is constituted as shown in FIGS. 4 and 5. Referring to FIGS. 4 and 5, the gear 49 on which the second end of the screw 47 is fixed is supported on a shaft 48 which is rotatably mounted on an inner wall of the first chamber 61*a*. A gear 50 is engaged with the gear 49, and a bevel gear 51 which is coaxingly integrated with the gear 50 is engaged with a bevel gear 52. A gear 53 which is coaxingly integrated with the bevel gear 52 is engaged with a gear 54 which is fixed on the shaft 44*a* for the agitator 44. That is, a rotational force of the shaft 44*a* for the agitator 44 is transmitted via the gears 54 and 53, the bevel gears 52 and 51 and the gears 50 and 49 to the screw 47. Thereby, the screw 47 is rotated when the agitator 44 of the developing device 14 is rotated.

Figure 7:
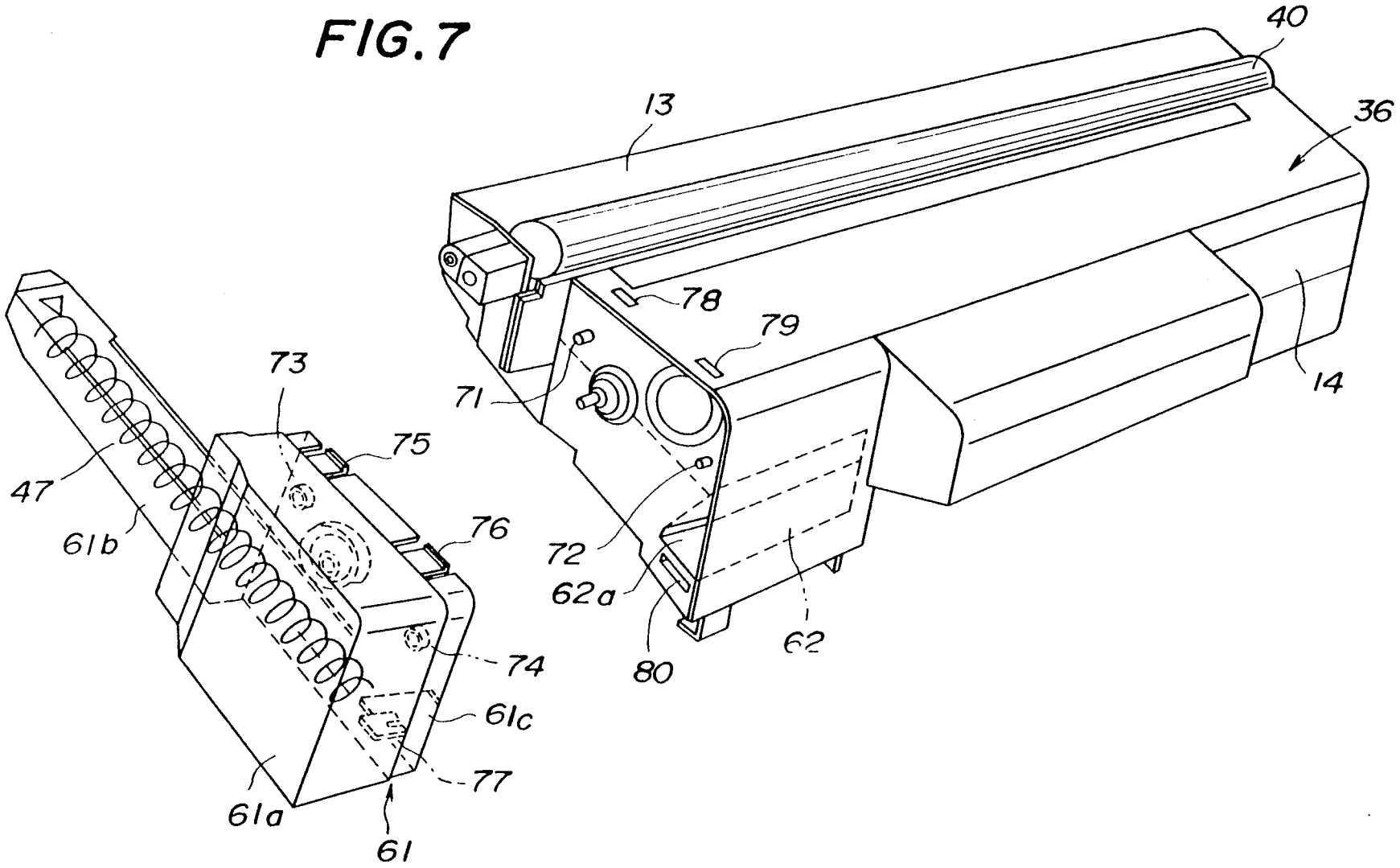
FIG. 7 is a perspective view showing how the storage box is connected to the process unit.

The second chamber 62 is formed in a space between the toner chamber 36 and a housing of the developing device 14, as shown in FIG. 7. The opening 62*a* of the second chamber 62 is exposed from the side wall of the housing of the developing device 14. The storage box 61 has mounting projection members 75, 76 and 77. Holes 73 and 74 are formed on a side surface of the storage box 61. Concave engagement portions 78, 79 and 80 are formed on the housing of the developing device 14, and bosses 71 and 72 are formed on the side wall of the housing of the developing device 14. The bosses 71 and 72 of the developing device 14 are engaged with corresponding holes 73 and 74, and the mounting projection members 75, 76 and 77 of the storage box 61 are respectively engaged with corresponding concave engagement portions 78, 79 and 80. Thereby, the storage box 61 is mounted on the side wall of the developing device 14, as shown in FIG. 3, so that the first chamber 61*a* and the second chamber 62 are connected to each other via an opening 61*c* of the first chamber 61*a* and the opening 62*a* of the second chamber 62.

In the process unit having the above structure, when printing operations are carried out in accordance with the electrophotography imaging process, the waste toner T which is ejected from the cleaning device 16 is fed via the feeding pipe 61*b* to the first chamber 61*a* of the storage box 61 by the rotating of the screw 47 which is rotated by the rotation of the agitator 44 of the developing device 14. When the amount of waste toner stored in the first chamber 61*a* reaches approximately a predetermined amount, the toner stored in the first chamber 61*a* is further fed via the openings 61*c* and 62*a* to the second chamber 62 by the rotating of the screw 47. Thereby, the first chamber 61*a* and the second chamber 62 can be approximately 100% filled with the waste toner, as shown in FIG. 6.

The more closer the end of the screw 47 is to the opening 62*a* of the second chamber 62, the larger the amount of waste toner that can be stored in the second chamber 62.

The present invention is not limited to the aforementioned embodiment, and variations and modifications may be made without departing from the scope of the claimed invention.

What is claimed is:

1. A process unit mounted in a housing of an electrophotography imaging apparatus in which an image is formed in accordance with an electrophotography process carried out on an image retaining member, said process unit comprising:

a developing device for supplying fresh developer to a latent image formed on the image retaining member to form on the image retaining member a visible image corresponding to said latent image;

a first chamber provided adjacent to said developing device to store waste developer apart from said fresh developer;

a second chamber provided in a space which is formed adjacent to said developing device and connected via an opening to said first chamber to store waste developer apart from said fresh developer; and a feeding mechanism, coupling a cleaning device provided in said electrophotography imaging apparatus to said first chamber, for feeding waste developer from said cleaning device to said first chamber, said waste developer being removed from the image retaining member by said cleaning device after the visible image is transferred from the image retaining member to a recording sheet, said feeding mechanism further feeding into said second chamber waste developer fed to said first chamber via the opening to said second chamber so that the waste developer is stored in said first and second chambers apart from said fresh developer.

2. A process unit as claimed in claim 1, wherein said process unit is detachably mounted in said housing of said electrophotography imaging apparatus.

3. A process unit as claimed in claim 1, wherein said feeding mechanism comprises a feeding pipe coupling said cleaning device and said first chamber to each other, a screw which extends in said feeding pipe and said first chamber, and a driving mechanism for rotating said screw, whereby the waste developer is fed through said feeding pipe to said first chamber by rotating said screw which is rotated by said driving mechanism.

4. A process unit as claimed in claim 3, wherein an end of said screw is adjacent to the opening between said first and second chambers.

5. A process unit as claimed in claim 3, wherein an end of said screw is located adjacent to a surface extending from an upstream side edge of said opening in a direction perpendicular to said opening, said upstream side edge being defined as an edge close to said feeding pipe.

6. A process unit mounted in a housing of an electrophotography imaging apparatus in which an image is formed in accordance with an electrophotography process carried out on an image retaining member, said process unit comprising:

for supplying fresh developer to a latent image formed on the image retaining member to form on the image retaining member a visible image corresponding to said latent image;

a first chamber provided adjacent to said developing device to store waste developer apart from said fresh developer, wherein said developing device extends in a predetermined direction, and wherein said first chamber is mounted adjacent to a side wall of said developing device;

a second chamber connected via an opening to said first chamber to store waste developer apart from said fresh developer; and a feeding mechanism, coupling a cleaning device provided in said electrophotography imaging apparatus to said first chamber, for feeding waste developer from said cleaning device to said first chamber, said waste developer being removed from the image retaining member by said cleaning device after the visible image is transferred from the image retaining member to a recording sheet, said feeding mechanism further feeding into said second chamber waste developer fed to said first chamber via the opening to said second chamber so that the waste developer is stored in said first and second chambers apart from said fresh developer.

7. A process unit as claimed in claim 6, wherein said second chamber is provided in a space which is formed adjacent to said developing device and said second chamber extends in a direction approximately parallel to the direction in which said developing device extends.

8. A process unit mounted in a housing of an electrophotography imaging apparatus in which an image is formed in accordance with an electrophotography process carried out on an image retaining member, said process unit comprising:

a developing device for supplying fresh developer to a latent image formed on the image retaining member to form on the image retaining member a visible image corresponding to said latent image;

a first chamber provided adjacent to said developing device to store waste developer apart from said fresh developer;

a second chamber connected via an opening to said first chamber to store waste developer apart from said fresh developer; and a feeding pipe coupling a cleaning device provided in said electrophotography imaging apparatus to said first chamber, a screw which extends in said feeding pipe and said first chamber, and a driving mechanism for rotating said screw developer to feed waste developer through said feeding pipe to said first chamber by rotating said screw with said driving mechanism, said waste developer being removed from the image retaining member by said cleaning device after the visible image is transferred from the image retaining member to a recording sheet, wherein said developing device includes a rotary agitator for agitating said fresh developer and said driving mechanism has a mechanism which transmits a rotational force of said agitator to said screw;

said feeding mechanism further feeding into said second chamber waste developer fed to said first chamber via the opening to said second chamber so that the waste developer is stored in said first and second chambers apart from said fresh developer.

9. A process unit mounted in a housing of an electrophotography imaging apparatus in which an image is formed in accordance with an electrophotography process carried out on an image retaining member, said process unit comprising:

a developing device for supplying fresh developer to a latent image formed on the image retaining member to form on the image retaining member a visible image corresponding to said latent image;

a first chamber provided adjacent to said developing device to store waste developer apart from said fresh developer;

a second chamber connected via an opening to said first chamber to store waste developer apart from said fresh developer, wherein said opening between said first and second chambers is formed in a surface approximately perpendicular to a bottom surface of the housing, and wherein said second chamber extends in a direction approximately perpendicular to the surface in which said opening is formed; and a feeding mechanism, coupling a cleaning device provided in said electrophotography imaging apparatus to said first chamber, for feeding waste developer from said cleaning device to said first chamber, said waste developer being removed from the image retaining member by said cleaning device after the visible image is transferred from the image retaining member to a recording sheet, said feeding mechanism further feeding into said second chamber waste developer fed to said first chamber via the opening to said second chamber so that the waste developer is stored in said first and second chambers apart from said fresh developer.

10. A process unit mounted in a housing of an electrophotography imaging apparatus in which an image is formed in accordance with an electrophotography process carried out on an image retaining member, said process unit comprising:

a developing device for supplying fresh developer to a latent image formed on the image retaining member to form on the image retaining member a visible image corresponding to said latent image, wherein said developing device has an agitator for agitating the developer, a bottom surface of said developing device corresponding in shape to the shape of said agitator;

a first chamber provided adjacent to said developing device to store waste developer apart from said fresh developer;

a second chamber connected via an opening to said first chamber to store waste developer apart from said fresh developer and provided in a space between said bottom surface of said developing device and said housing; and a feeding mechanism, coupling a cleaning device provided in said electrophotography imaging apparatus to said first chamber, for feeding waste developer from said cleaning device to said first chamber, said waste developer being removed from the image retaining member by said cleaning device after the visible image is transferred from the image retaining member to a recording sheet, said feeding mechanism further feeding into said second chamber waste developer fed to said first chamber via the opening to said second chamber so that the waste developer is stored in said first and second chambers apart from said fresh developer.

11. An electrophotography imaging apparatus comprising:

an image retaining member;

an imaging device forming a latent image on said image retaining member;

a detachable process unit comprising a developing device having a storage chamber for fresh developer and applying fresh developer to said latent image to develop the latent image into a visible image;

a transfer device transferring said visible image from the image retaining member to a record member;

a cleaning device removing waste developer from said image retaining member after said visible image has been transferred from the image retaining member to said record member a first chamber for storing waste developer;

a second chamber for storing waste developer;

said cleaning device delivering waste developer removed from said image retaining member to at least one of said first and second chambers; and said first and second chambers being in communication with each other, but not with said chamber for fresh developer, so that waste developer from one of said first and second chambers can flow into the other but not into said chamber for fresh developer;

a feeding pipe coupling said cleaning device and said first chamber to each other, a screw which extends in said feeding pipe and said first chamber, and a driving mechanism for rotating said screw to feed waste developer through said feeding pipe to said first chamber by rotating said screw with said driving mechanism;

wherein said developing device has a rotary agitator for agitating fresh developer in said developing device and said driving mechanism has a mechanism which transmits a rotational force of said agitator to said screw.

12. An electrograph imaging apparatus comprising:

an image retaining member;

an imaging device forming a latent image on said image retaining member;

a detachable process unit comprising a developing device having a storage chamber for fresh developer and applying fresh developer to said latent image to develop the latent image into a visible image;

a transfer device transferring said visible image from the image retaining member to a record member;

a cleaning device removing waste developer from said image retaining member after said visible image has been transferred from the image retaining member to said record member;

a first chamber for storing waste developer;

a second chamber for storing waste developer;

said cleaning device delivering waste developer removed from said image retaining member to at least one of said first and second chambers; and said first and second chambers being in communication with each other, but not with said chamber for fresh developer, so that waste developer from one of said first and second chambers can flow into the other but not into said chamber for fresh developer, wherein said developing device extends in a predetermined direction, and wherein said first chamber is adjacent a side wall of said developing device.

13. An apparatus as claimed in claim 12, further comprising a feeding pipe coupling said cleaning device and said first chamber to each other, a screw which extends in said feeding pipe and said first chamber, and a driving mechanism for rotating said screw to feed waste developer through said feeding pipe to said first chamber by rotating said screw with said driving mechanism.

14. An apparatus as claimed in claim 13, wherein a portion of said screw is at a position adjacent to an opening between said first and second chambers.

15. An apparatus as claimed in claim 12, wherein said second chamber is connected via an opening to said first chamber and waste developer in said first chamber is further fed via the opening to said second chamber.

16. A detachable process unit as claimed in claim 12, wherein said second chamber is in a space which is formed adjacent to said developing device to extend in a direction approximately parallel to the direction in which said developing device extends.

17. A process unit mounted in a housing of an electrophotography imaging apparatus in which an image is formed in accordance with an electrophotography process carried out on an image retaining member, said process unit comprising:

a developing device for supplying fresh developer to a latent image formed on the image retaining member to form on the image retaining member a visible image corresponding to said latent image;

a first chamber provided adjacent to said developing device to store waste developer apart from said fresh developer;

a second chamber, provided in a space which is formed adjacent to said developing device, connected via an opening to said first chamber to store waste developer apart from said fresh developer; and a feeding mechanism for feeding waste developer to said first chamber, said waste developer being removed from the image retaining member by a cleaning device in said electrophotography imaging apparatus after the visible image is transferred from the image retaining member to a recording sheet, said feeding mechanism further feeding into said second chamber waste developer fed to said first chamber via the opening to said second chamber so that the waste developer is stored in said first and second chambers apart from said fresh developer.

18. A process unit as claimed in claim 17, wherein said developing device extends in a predetermined direction, and wherein said first chamber is mounted adjacent to a side wall of said developing device and said second chamber extends in a direction approximately parallel to the direction in which said developing device extends.

* * * * *